US005190182A

United States Patent [19]

Copas et al.

[11] Patent Number: 5,190,182

[45] Date of Patent: Mar. 2, 1993

[54] SLIDE GATE

[75] Inventors: Jimmy W. Copas, Clover, S.C.; Roderick G. MacLennan, III, Matthews, N.C.; Thomas L. Overcash; Michael D. Sawyer, both of Charlotte, N.C.; Thomas D. Willingham, Rock Hill, S.C.

[73] Assignee: Hoechst Celanese Corporation, Somerville, N.J.

[21] Appl. No.: 850,756

[22] Filed: Mar. 13, 1992

[51] Int. Cl.[5] ..... B65D 43/20

[52] U.S. Cl. ..... 220/345; 220/262; 220/346; 220/378; 110/173 R

[58] Field of Search ..... 220/345, 262, 325, 346, 220/211, 378, 348; 110/173 R

[56] References Cited

U.S. PATENT DOCUMENTS

| | | | |
|---|---|---|---|
| 744,214 | 11/1903 | Lowe | 220/345 X |
| 853,168 | 5/1907 | Garbe | 220/345 X |
| 977,271 | 11/1910 | Callaghan | 220/345 X |
| 2,293,160 | 8/1942 | Miller et al. . | |
| 2,523,981 | 9/1950 | Wittliff, Jr. . | |
| 2,558,220 | 6/1951 | McLachlan | 220/262 X |
| 2,652,946 | 9/1953 | Beatty | 220/345 X |
| 2,750,074 | 6/1956 | Dorey . | |
| 3,220,612 | 11/1965 | Thomson . | |
| 3,224,382 | 12/1965 | Floehr | 220/345 X |
| 3,344,958 | 10/1967 | Kaanehe . | |
| 3,581,673 | 6/1971 | Danielson | 105/253 |
| 3,670,583 | 6/1972 | Leming | 74/89.15 |
| 3,718,231 | 2/1973 | O'Connor | 220/345 X |
| 4,322,914 | 4/1982 | McGaughey . | |
| 4,475,672 | 10/1984 | Whitehead . | |
| 4,746,034 | 5/1988 | Ata et al. . | |
| 4,785,966 | 11/1988 | Waltke | 220/345 |
| 4,819,829 | 4/1989 | Rosten et al. . | |

FOREIGN PATENT DOCUMENTS

| | | | |
|---|---|---|---|
| 138696 | 11/1960 | U.S.S.R. | 220/345 |

*Primary Examiner*—Allan N. Shoap
*Assistant Examiner*—Paul A. Schwarz
*Attorney, Agent, or Firm*—Depaoli & O'Brien

[57] ABSTRACT

A slide gate closure is provided for bottom discharge bins which are used for storing and transporting large quantities of dry chemicals. The slide gate includes screw means attached to the gate whereby the contents of the container may be fully or partially removed through a discharge opening by rotation of the screw means. Wedges are provided on and about the gate to form a six point contact between the slide gate and a sealing gasket.

3 Claims, 2 Drawing Sheets

SLIDE GATE

This invention relates to closure assemblies for bottom discharge bins used for storing and transporting large quantities of dry chemicals and, more particularly, to a new and useful slide gate closure therefor.

BACKGROUND OF THE INVENTION

Various closure assemblies have been heretofore suggested for closing and sealing discharge openings in containers which are designed for storing and transporting bulk chemical materials. These containers often have a bottom discharge opening with a sliding gate type closure which permits the contents to be discharged when the gate is open and shut off when the gate is closed. Gates of this type are particularly important since in storing or transporting large volumes of hazardous chemicals, such as powdered sodium hydrosulfite, any escape of the powder poses a serious health problem and potential fire hazard.

U.S. Pat. No. 4,785,966 discloses a slide gate assembly in which elongated cam bars (34) and (36) are used in conjunction with a flexible seal (50) having a yieldable wiper lip (54) which is in contact with the slide gate when the cams are rotated between a first engaged and closed position (FIG. 6) and a second disengaged position (FIG. 7). While slide gates of this type have been used on returnable aluminum container bins for transporting dry chemicals in amounts approximating 4,400 pounds net weight, they suffer from several disadvantages. Due to the heavy weight of the overlying material, it is important to reduce friction on opening and closing the gate as much as possible. In rotating the cam bar, for example, it is necessary for the operator to physically hammer the cam bars to the disengaged position and then, in most instances, use a come-along to pull the slide gate open. Due to the heavy weight and friction the slide gate may suddenly pop open during opening and the operator then becomes at risk from the escaping powder. While gates of this type are acceptable and meet the requirements of DOT 56 specifications, they suffer the disadvantage of not effectively closing the discharge opening when it is closed and not safely opening the slide gate with repeated cycles of opening and closing.

SUMMARY OF THE INVENTION

The present invention provides an improved form of a slide gate closure for bulk container bins having a bottom discharge opening. The closure, which is secured to the bin by welding, includes screw means attached to a knife gate for opening the gate so that the contents of the container may be fully or partially removed through a discharge opening and then reclosed for future use. In the closed position, the gate is tightly sandwiched between a gasket or seal disposed around the periphery of the discharge opening and a series of wedge means disposed on and around the knife gate. Optional visual indicator means may be further provided to indicate when the gate is opened or closed.

BRIEF DESCRIPTION OF THE DRAWINGS

The invention is described in greater detail in the following description of examples embodying the best mode of the invention taken in conjunction with the drawing figures in which.

DESCRIPTION OF THE PREFERRED EMBODIMENTS

Figure 1:
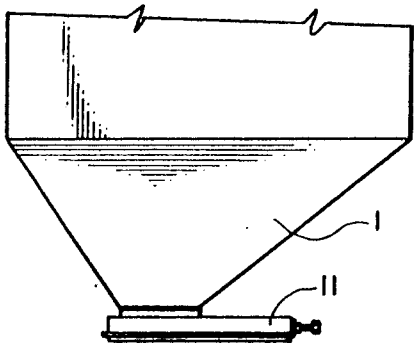
FIG. 1 is a front elevational view showing the slide gate closure mounted on a container bin.
Figure 2:
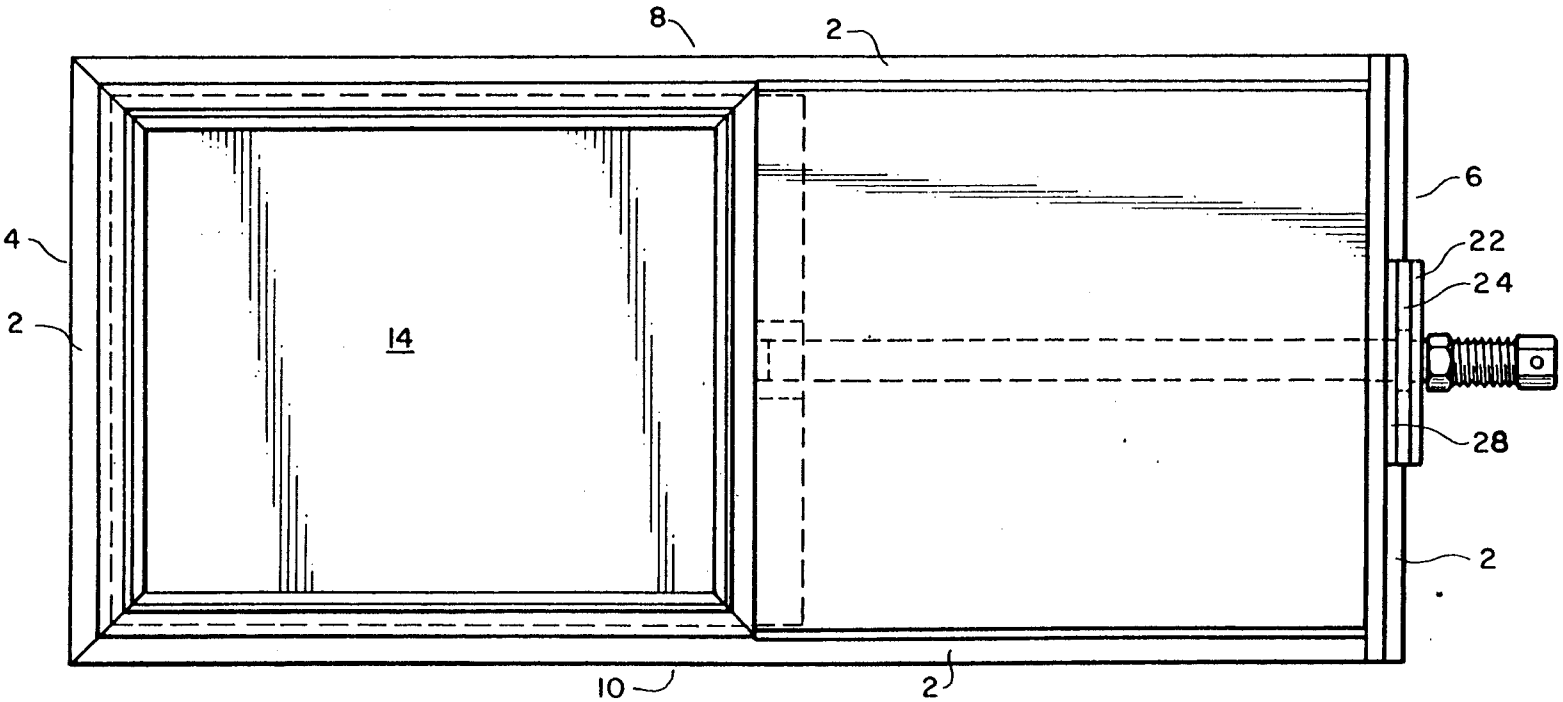
FIG. 2 is a top plan view of the slide gate closure.
Figure 3:
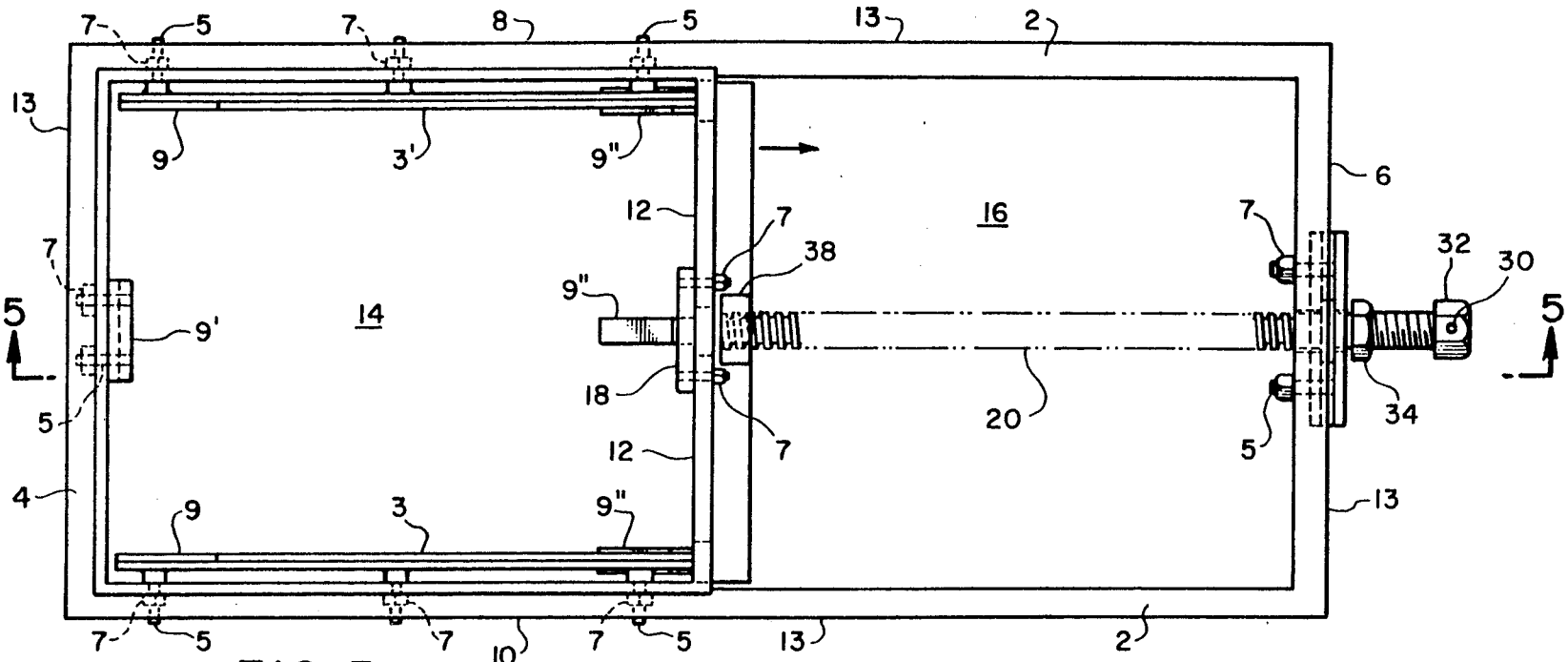
FIG. 3 is a bottom plan view of the slide gate closure.
Figure 4:
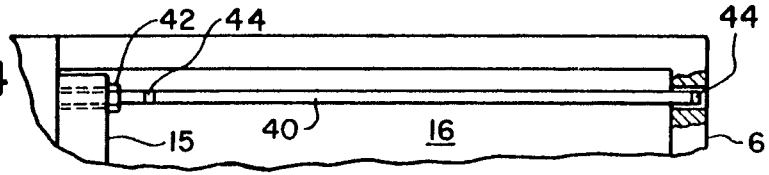
FIG. 4 is a fragmentary bottom plan view showing an optional visual indicator.

As shown in FIG. 1, the slide gate closure 11 is mounted on a bottom discharge bin 1 typically used for storing and transporting large quantities of dry chemicals. In FIGS. 2 and 3, the gate closure comprises a rectangular housing frame 2 having respective front and rear end walls 4 and 6 and left and right side walls 8 and 10 which terminate in a lower peripheral side flange 13 which extends about the entire perimeter of the housing frame. A cross bar 12 is centrally located within the housing 2 and divides the housing into a rectangular gate section 14 which is opened or closed, and a rectangular closed cover section 16 which houses the slide gate when it is opened. As better seen in FIG. 3, the gate section 14 contains two spaced parallel side risers 3 and 3' which run from front to rear of the gate section inside the frame. The risers are attached to side walls 8 and 10 by means of spaced screw studs 5 which are welded thereto and pass through apertures to the outside of the side walls where they are locked in place by means of Nylock hex nuts 7. Wedges 9 are welded on the front portion of each side wall riser and are chamfered so as to matingly receive the beveled 45° front edge of knife gate 15 when the gate is closed. Each wedge is likewise secured to the sidewalls by screw studs 5 which pass through the wedges and apertures to the outside of the side walls 8 and 10 where they are also locked in place by means of Nylock hex nuts 7. Each side riser is thus preferably secured to side walls by three equally spaced screw studs.

The forward front section inside the gate housing further has a bevelled front wedge plate 9' centrally mounted where the leading edge of the gate would be when the gate is in the closed position. The front wedge plate 9' is also attached by means of two screw studs 5 which pass through apertures to the outside of end wall 4 where they are locked in place by means of Nylock hex nuts 7.

On the underside of knife gate 15 and at the rear end of its shorter dimension, three space beveled wedges 9'' are welded directly to the slide gate near the end thereof as shown in FIG. 3. The two outside wedges ride up on side risers 3 and 3' in closing the gate whereas the rear center wedge rides up on a block 18 which is not beveled and is attached to the forward face of cross bar 12 by means of screw studs 5 which pass through the block and are locked in place by Nylock hex nuts 7.

Figure 5:
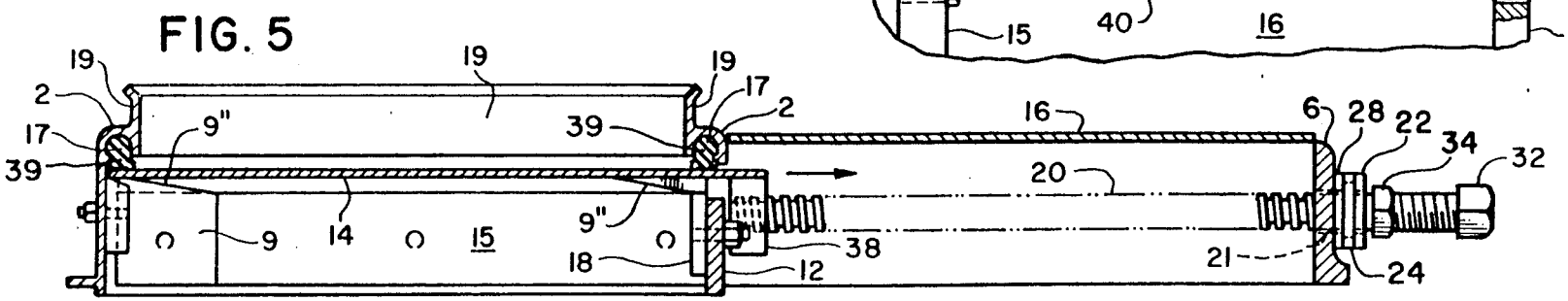
FIG. 5 is a longitudinal cross sectional view taken along lines 5—5 of FIG. 3.

In order to open or close the knife gate, a transmission screw is centrally mounted lengthwise in the cover section 16. As shown in FIGS. 3 and 5, the screw consists of a threaded left hand acme screw 20 which is journaled at 21 and extends through the end member 6 by means of capture plate 22, spacer plate 24, thrust washer (not shown) and thrust plate 28. A shear pin 30, transmission drive nut 32 and lock nut 34 are suitably provided on the end of the screw outside rear end wall 6 for turning and locking the screw. The forward end of screw 20 is received in an acme threaded hole in support bar 38 which is vertically upright and welded to the end of knife gate 15.

As a typical example of the gate closure, where the rectangular housing frame has an overall dimension of 2 feet, 1-$\frac{7}{8}$ inches long and 1 foot wide and is divided into two sections by means of a 12-inch cross bar, the transmission screw is $\frac{3}{4}$ diameter and has a total overall length of one foot, 3-$\frac{3}{8}$ inches of which 11-$\frac{5}{8}$ inches is 6LH acme thread and 2-$\frac{7}{8}$ inches is standard $\frac{3}{4}\times 10$ course thread. The standard thread is drilled near the end for a shear pin and contains a thrust washer approximately 2-$\frac{7}{8}$ inches from the end. The side risers are 11-$\frac{3}{4}$ inches long and are secured to the inside of each side wall by means of three stainless steel studs located 5 inches off center.

As shown in FIG. 5, a yieldable rubber frame gasket 38 is disposed in an h shape channel 17 formed between the discharge passage member 19 and housing frame 2. The gasket or seal is known in the art and is made of a compressible rubber such as a four-groove or four-ridge 60 durometer neoprene rubber. The seal is continuous and extends around the entire lower periphery of the rectangular gate section in channel 17 with the yieldable ribs, which project downward from the bottom discharge member, forming a positive closure seal when the slide gate is in the closed position.

The slide gate is in the closed position when the bin is initially loaded for storage or transport. This is accomplished by turning the transmission drive nut 32 clockwise until the slide gate rides up on the front and rear wedges and is fully closed. The transmission screw is then secured in place by means of lock nut 34 which is tightened. When it is desired to use the bin, the lock nut is loosened and the transmission screw is turned counterclockwise with a suitable wrench to the desired degree of opening. In contrast to the prior art cam type slide gates, which are either fully open or fully closed, the invention provides an improved slide gate whereby the contents of the container may be fully or partially removed through the discharge opening by using the slide gate as a metering device.

As a further embodiment, the slide gate 15 may, if desired, have an indicator rod 40 attached to the end thereof which projects rearwardly from the gate and passes through an opening or aperture in rear end wall 6 when the gate is fully opened. The indicator rod may be secured to the rear end of the gate by means of a threaded long nut (not shown) welded behind the rear wedge in which the rod is inserted and locked in place by a jam nut 42. The indicator rod 40 is preferably marked or painted red 44 on each end to show a fully opened, partially opened or closed position. In the closed position, the red marking cannot be seen. As the slide gate opens, however, the red mark 44 on the indicator rod near the slide gate appears outside of the opening, thus indicating the fully opened position. Obviously, the indicator rod may have several painted or marked positions to indicate any degree of opening or closing of the slide gate.

What is claimed is:

1. In a container for storage and transporting bulk material having an open bottom discharge passage member and slide gate attached below said passage member wherein a seal is provided between the discharge passage member and slide gate said seal being disposed around a periphery of the discharge passage member, the improvement of acme screw means attached to said slide gate for horizontal movement of the slide gate between an open and closed position, said slide gate having a plurality of spaced wedges located on an underside of the slide gate near a rear end thereof; a wedge attached to each of a front portion of two spaced parallel side wall risers said rises being attached to left and right side walls of a housing frame; and a wedge attached to a forward front section inside the gate housing frame whereby in the closed position said slide gate is tightly sandwiched between the seal disposed around the periphery of he discharge passage member and the slide gate.

2. The improvement of claim 1 wherein the screw means is centrally mounted lengthwise in a cover section and is received in a threaded hole in a bar attached to the end of the slide gate and is journaled at the other end thereof in the end member of the cover section.

3. The improvement of claim 2 wherein the screw means extends through the end member of the cover section and contains a drive nut and locking nut for moving and locking said screw means in an open or closed position.

* * * * *